US006659080B2

(12) United States Patent
Costin et al.

(10) Patent No.: US 6,659,080 B2
(45) Date of Patent: Dec. 9, 2003

(54) METHODS AND APPARATUS FOR ADJUSTING A THROTTLE OF A VEHICLE ENGINE

(75) Inventors: Mark Henry Costin, Bloomfield Township, MI (US); Paul Alan Bauerle, Fenton, MI (US); Robert J. Schaller, Brighton, MI (US); John Norman Stockbridge, Novi, MI (US); Mario Vincent Maiorana, Jr., Davisburg, MI (US); James T. Purcell, Goleta, CA (US); Robert Charles Simon, Jr., Novi, MI (US)

(73) Assignee: General Motors Corporation, Detroit, MI (US)

( * ) Notice: Subject to any disclaimer, the term of this patent is extended or adjusted under 35 U.S.C. 154(b) by 136 days.

(21) Appl. No.: 09/916,184

(22) Filed: Jul. 26, 2001

(65) Prior Publication Data

US 2003/0019474 A1 Jan. 30, 2003

(51) Int. Cl.[7] ..... F02D 1/00
(52) U.S. Cl. ..... 123/399; 701/110; 123/396
(58) Field of Search ..... 123/399, 396; 710/110, 115

(56) References Cited

U.S. PATENT DOCUMENTS

| | | | | | |
|---|---|---|---|---|---|
| 4,266,274 | A | * | 5/1981 | Barman | 701/108 |
| 4,348,729 | A | * | 9/1982 | Sasayama et al. | 701/115 |
| 6,119,063 | A | * | 9/2000 | Hieb et al. | 701/110 |
| 6,246,951 | B1 | * | 6/2001 | Robichaux et al. | 701/110 |
| 6,332,450 | B1 | * | 12/2001 | Muto et al. | 123/352 |
| 6,351,704 | B1 | * | 2/2002 | Koerner | 701/115 |

* cited by examiner

*Primary Examiner*—John Kwon
(74) *Attorney, Agent, or Firm*—Christopher DeVries

(57) ABSTRACT

Methods and apparatus are provided for adjusting a throttle of a vehicle engine. The apparatus comprises an input sensor configured to provide an input signal having a value that approximately corresponds to an operating level of the vehicle engine requested by an operator and a memory configured to store a maximum input value for the input sensor. The maximum input value provides the value of the input signal that approximately corresponds to a maximum operating level of the vehicle engine. The apparatus is further configured to receive the input signal and access the memory to retrieve the maximum input value and further configured to update the maximum input value with the value of the input signal if the value of the input signal is greater than the maximum input value.

20 Claims, 2 Drawing Sheets

METHODS AND APPARATUS FOR ADJUSTING A THROTTLE OF A VEHICLE ENGINE

TECHNICAL FIELD

The present invention generally relates to vehicle controls and, more particularly, to methods and apparatus for adjusting a throttle of a vehicle engine.

BACKGROUND OF THE INVENTION

Operation of a vehicle generally includes operator adjustment of a throttle to select the operating level of the vehicle engine. For example, operation of an automobile generally includes adjusting the fuel injectors, engine spark and amount of airflow through an intake manifold to an intake port of an internal combustion engine in response to operator adjustment of the throttle. The operator adjustment of the throttle is typically accomplished with an input mechanism, such as a foot pedal, joystick, hand pedal, lever or track ball, which is coupled to an input sensor. The input sensor provides an input signal to a processor that generates the control signals for the hardware of the vehicle engine to provide the operating level indicated by the input mechanism.

The ability of the operator to accurately adjust the input mechanism for a maximum operating level of the vehicle engine can be limited by a number of factors. For example, the physical characteristics of an operator (e.g., height) can limit the ability of the operator to position the input mechanism at a location that provides the maximum operating level of the vehicle engine. In addition, variations in the placement of the input mechanism within a vehicle compartment or variations in obstructions to the motion of the input mechanism (e.g., floor mat thickness) can limit the ability of an operator to obtain the maximum operating level. Therefore, these and other factors that limit the ability of the operator to adjust the input mechanism for a maximum operating level of the vehicle engine can result in undesirable attributes of the throttle, such as a dead pedal at maximum pedal travel.

In view of the foregoing, it should be appreciated that it would be desirable to provide methods and apparatus for adjusting a throttle of a vehicle engine to address these and other variations that limit the ability of an operator to accurately obtain the maximum operating level of the vehicle engine. Furthermore, additional desirable features will become apparent to one skilled in the art from the foregoing background of the invention and following detailed description of a preferred exemplary embodiment and appended claims.

SUMMARY OF THE INVENTION

In accordance with the teachings of the present invention, methods and apparatus are provided for adjusting a throttle of a vehicle engine to obtain the maximum operating level of the vehicle engine. The apparatus comprises an input sensor configured to provide an input signal having a value that corresponds to an operating level of the vehicle engine requested by an operator and a memory configured to store a maximum input value for the input sensor. The maximum input value provides the value of the input signal that corresponds to a maximum operating level of the vehicle engine. The apparatus is further configured to receive the input signal and access the memory to retrieve the maximum input value and further configured to update the maximum input value with the value of the input signal if the value of the input signal is greater than the maximum input value. The processor is also configured to generate a throttle control signal that controls the throttle of the vehicle engine using the maximum input value and the input signal.

BRIEF DESCRIPTION OF THE DRAWINGS

The present invention will hereinafter be described in conjunction with the appended drawing figures, wherein like numerals denote like elements, and.

DESCRIPTION OF PREFERRED EXEMPLARY EMBODIMENTS

The following detailed description of preferred exemplary embodiments of the invention is mainly exemplary in nature and is not intended to limit the invention or the application or use of the invention.

Figure 2:
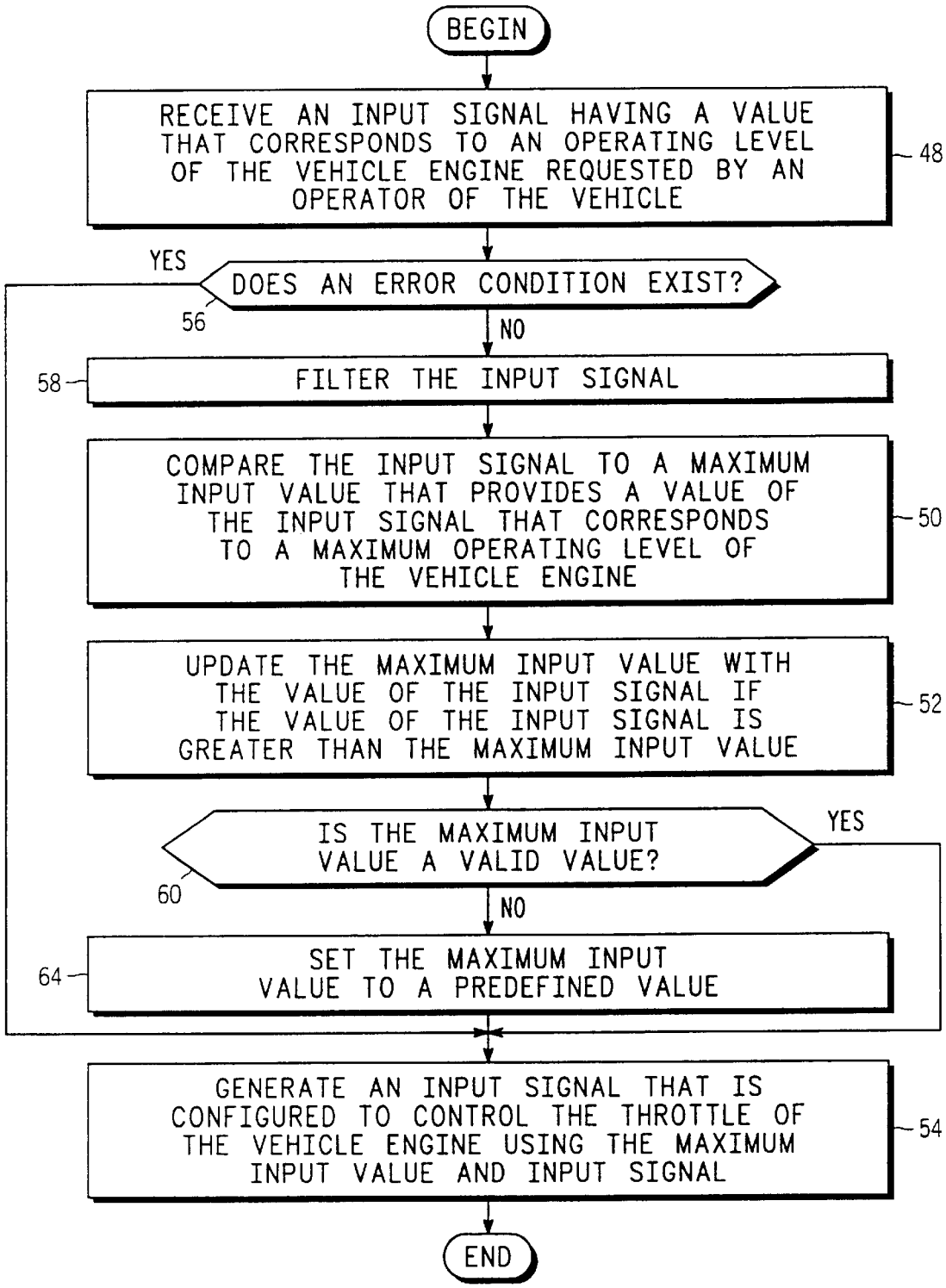
FIG. 2 is a flow chart illustrating a method for adjusting a throttle of a vehicle engine according to a preferred exemplary embodiment of the present invention.

Referring to FIG. 2, an apparatus 20 is illustrated for adjusting a throttle 22 of a vehicle engine 24 according to a preferred exemplary embodiment of the present invention. The apparatus 20 is comprised of an input sensor 26 that is configured to provide an input signal 28 having a value that approximately corresponds to an operating level of the vehicle engine 24 requested by an operator (not shown). The apparatus 20 is also comprised of a memory 30 that is configured to store a maximum input value (e.g., MAX_INPUT_1) 32 for the input sensor 26 and a processor 34 configured to receive the input signal 28 provided by the input sensor 26. The processor 30 is also configured to access the memory 30 to retrieve the maximum input value 32. The processor 34 is further configured to compare the value of the input signal 28 and the maximum input value 32 and update the maximum input value 32 with the value of the input signal 28 if the value of the input signal 28 is greater than the maximum input value 32.

In addition to comparing the value of the input signal 28 and the maximum input value 32 and updating the maximum input value 32 with the value of the input signal if the value of the input signal 28 is greater than the maximum input value 32, the processor 34 is configured to generate a throttle control signal 36 that controls the throttle 22 of the vehicle engine 24 using the maximum input value 32 and the input signal 28. The processor 34 can be configured to generate the throttle control signal 36 that reflects the operating level of the vehicle engine 24 requested by the operator using any number of methods. For example, and without any intention to limit the invention to this method of generating the throttle control signal 36, the processor 34 can be configured to determine a ratio of the maximum input value 32 to the input signal 28 [e.g., (value of the input signal 28)/(maximum input value 32)] and generate the throttle control 36 that provides the fraction of the maximum operating level for the vehicle engine of the determined ratio [e.g., $5/10$=a throttle control signal 36 that configures the throttle for fifty percent (50%) of the maximum operating level of the vehicle engine]. However, as previously described in this detailed description of preferred embodiments, any number of methods can be utilized to generate the throttle control signal 36 using the maximum input value 32. Furthermore, any number of throttle configurations and any number of vehicle engines for any number of land (e.g., automobiles, trains), air (e.g., aircraft), water (e.g., ships) and space vehicles can be utilized in accordance with the present invention.

For example, and for illustrative purposes only, the throttle 22 can include an electronically-controlled intake valve 38, such as a butterfly or rotary intake air valve, disposed within an intake bore 40, which rotates to adjust a flow rate of air through the intake bore 40 to the vehicle engine 24, which is an internal combustion engine in this illustrative example. An electromechanical actuator 42, such as a Direct Current (DC) motor or step motor, is mechanically linked to the electronically-controlled intake valve 38 with a rotatable output shaft (not shown). The rotational position of the output shaft and the corresponding flow rate of air to the vehicle engine 24 are controlled through the variation of the throttle control signal 36 issued by the processor 30.

As previously described in this detailed description of preferred exemplary embodiments, the processor 34 is configured to generate the throttle control signal 36 that controls the throttle 22 of the vehicle engine 24 using the maximum input value 32 and the input signal 28. The input sensor 26 preferably produces the input signal 28 as the operator alters the position of the input mechanism 44, such as an accelerator pedal. However, any number of input mechanisms can be used in accordance with the present invention, such as a foot pedal, hand pedal, joystick, lever or trackball. The operator to request an operating level of the vehicle engine 24 uses the input mechanism 44. The position of the input mechanism 44 is detected by the input sensor 26, which can be any number of sensors such as a potentiometric position sensor, and converted to the input signal 24 using any number of techniques, such as a transduction. As can be appreciated by one of ordinary skill in the art, the apparatus 20 for adjusting the throttle of the vehicle engine 22 as previously described in this detailed description of preferred embodiments provides numerous benefits, and a method 46 for adjusting a throttle of a vehicle engine is illustrated in FIG. 2 according to a preferred exemplary embodiment of the present invention, which can be utilized with the apparatus 20 of FIG. 1.

Figure 1:
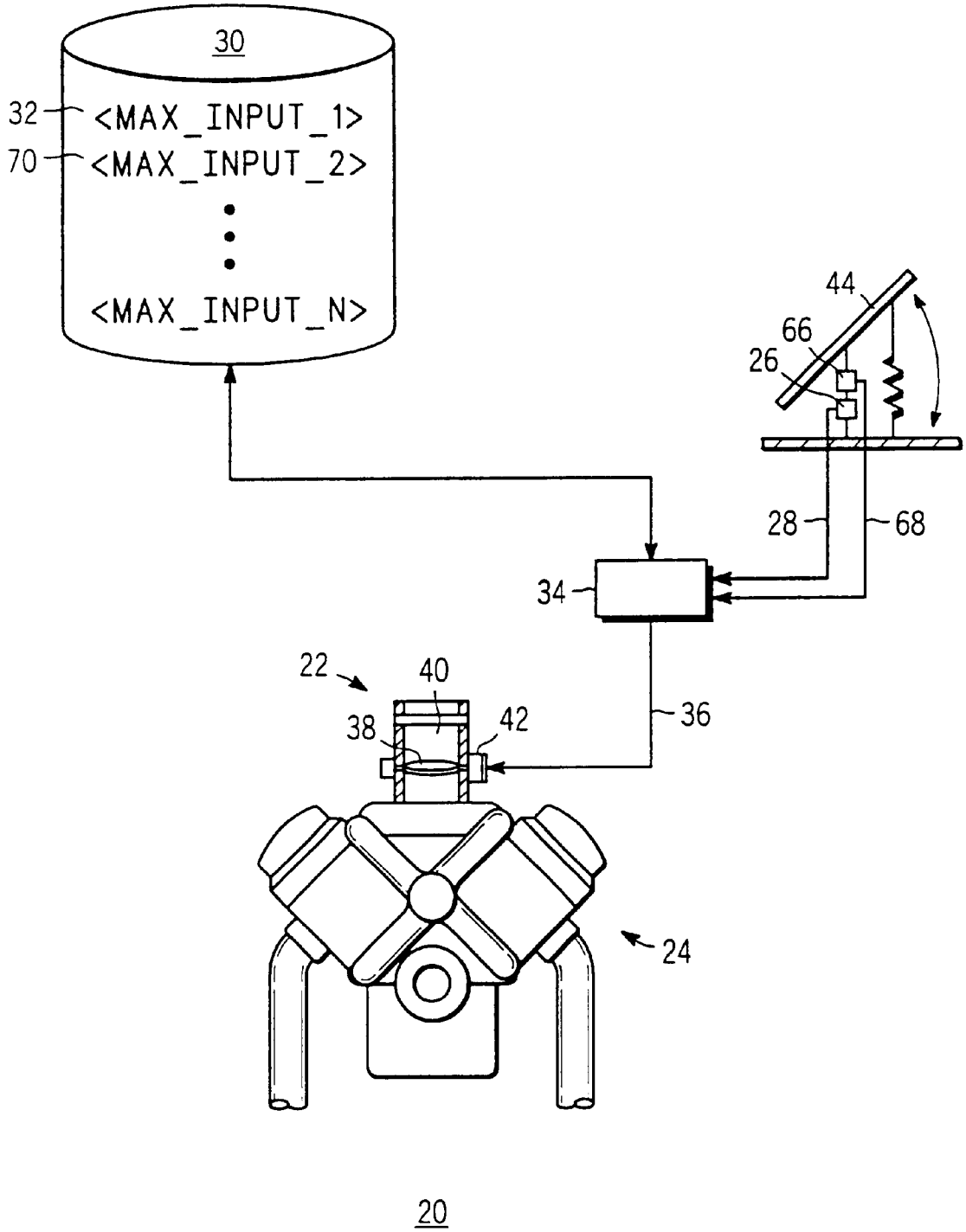
FIG. 1 is a simplified diagram of an apparatus for adjusting a throttle of a vehicle engine according to a preferred exemplary embodiment of the present invention.

Referring to FIG. 1, the method 46 is comprised of receiving the input signal having a value that corresponds to an operating level of the vehicle engine requested by the operator of the vehicle 48 and comparing the input signal to a maximum input value that provides a value of the input signal that approximately corresponds to a maximum operating level of the vehicle engine 50. The method 46 is further comprised of updating the maximum input value with the value of the input signal if the value of the input signal is greater than the maximum input value 52. In addition, the method 46 is also comprised of generating a throttle control signal that is configured to control the vehicle engine using the maximum input value and input signal 54. Furthermore, the method 46 can also optionally include determining whether an error condition exists 56, filtering the input signal 58, and determining whether the maximum input value is a valid value 60 in accordance with the present invention.

More specifically, the method 46 can be configured to determine whether any number of error conditions exist 56 that directly or indirectly relate to the throttle function of the vehicle engine. For example, an evaluation of the input signal can be conducted to determine if the accelerator position signal is out of a predetermined range or determine whether an electrical short is present. If a determination is made that an error condition exists, the method 64 continues with generating the throttle control signal that is configured to control the throttle of the vehicle engine using the maximum input value and the input signal 54 without comparing the input signal to a maximum input value that provides a value of the input signal, which corresponds to the maximum operating level of the vehicle engine 50 and subsequent steps. Otherwise, the method 46 preferably continues with comparing the input signal to the maximum input value that provides a value of the input signal, which corresponds to a maximum operating level of the vehicle engine 50 after the filtering of the input signal 58.

The input signal 54 can be filtered with any number of filters such as a first order lag filter. The filtering of the input signal 58 and determining whether an error condition exists 56 prior to comparing the throttle position to the maximum input value 50 increase the fault tolerance of the method 46, and the fault tolerance of the method 46 can also be increased with determining whether the maximum input value is a valid value 60 after updating the maximum input value with the value of the input signal if the value of the input signal is greater than the maximum input value 52.

The determining whether the maximum input value is a valid value 60 can include any number of validation conditions. For example and without any intention to limit the validation conditions, the validation conditions can include a predefined minimum value and a predefined maximum value that define a valid range for the maximum input value, which is considered to be invalid if the value is outside the range (i.e., the maximum input value is greater than and/or equal to the predefined maximum value or less than and/or equal to the predefined minimum value). If the determination is made that the maximum input value is not valid, the maximum input value is preferably set to a predefined value 64 prior to generating the throttle control signal that is configured to control the throttle of the vehicle engine using the maximum input value and input signal 54. In addition to determining whether the maximum input value is a valid value 60, determining whether an error condition exists 56 and/or filtering the input signal 58, fault tolerance can also be increased with verification of the memory 30 of FIG. 1.

For example and with reference to FIG. 1, the memory 30 that is configured to store the maximum input value 32 is preferably a Keep-Alive-Memory (KAM). This provides for a retention of the adjusted maximum input value 32 from key-cycle to key-cycle of the vehicle. However, in order to ensure that an appropriate value for the maximum input value 32 is retained from key-cycle to key-cycle, a memory corruption test is preferably conducted on the memory 30 and the maximum input value 32 is reset to a predefined value if the memory fails the memory corruption test. In addition, the apparatus 20 can be configured to reduce the maximum input value 32.

More specifically and according to another embodiment of the present invention, the processor 34 can be configured to access the memory 30, retrieve the maximum input value 32, and decrement the maximum input value 32 by a predetermined amount at least once per key-cycle. The processor 30 can also be provided with a minimum value, below which the processor 30 cannot reduce the maximum input value 32, and a maximum value, above which the processor 30 cannot increase the maximum input value 32. As can be appreciated by one of ordinary skill in the art, this provides for adjustment of the throttle if the limitations to the ability of the operation to position the input mechanism at a location that provides the maximum operating level of the vehicle engine is removed or reduced or an operator with different limitations is operating the vehicle.

Continuing with reference to FIG. 2, hardware redundancy is preferably provided in another preferred embodiment of the present invention to increase fault tolerance. The hardware redundancy can be provided with a second input sensor 66 that is configured to provide a second input signal 68 having a second value that approximately corresponds to the operating level of the vehicle engine 24 requested by an operator (not shown). The memory 30 is also configured to store a second maximum input value (e.g., MAX_INPUT_2) 70 for the second input sensor 66, and the processor 34 is configured to receive the second input signal 68 provided by the input sensor 66 and access the memory 30 to retrieve the second maximum input value 70. The processor 34 is further configured to compare the value of the input signal 28 and the maximum input value 32 and compare the value of the second input signal 68 and the second maximum input value 70 and update the maximum input value 32 with the value of the input signal 28 and update the second maximum input value 70 with the value of the second input signal 68 if the value of the input signal 28 is greater than the maximum input value 32 and the value of the second input signal 68 is greater than the second maximum input value 70.

In addition to comparing the values of the input signals (28,68) and the maximum input values (32,70) and updating the maximum input values (32,70) with the values of the input signals (28,68) if the values of the input signals (28,68) are greater than the maximum input values (32,70), the processor 34 is configured to generate the throttle control signal 36 that controls the throttle 22 of the vehicle engine 24 using the first maximum input value 32 and the second maximum throttle value 70. The processor 34 can be configured to generate the throttle control signal 36 that reflects the operating level of the vehicle engine 24 requested by the operator as previously described in this detailed description of preferred embodiments with fault tolerance. The fault tolerance can be provided with a greater number of input sensors than the input sensor 26 and the second input sensor 66, a greater number of input signals than the input signal 28 and the second input signal 68, and a greater number of maximum input values than the maximum input value 32 and the second maximum input value 70. In addition, as can be appreciated by one of ordinary skill in the art, the method 46 for adjusting a throttle of a vehicle engine of FIG. 2 can be modified to include steps that incorporate the redundant hardware as previously described for the preceding embodiment of the present invention.

From the foregoing detailed description of preferred exemplary embodiments, it should be appreciated that apparatus and methods are provided for adjusting a throttle of a vehicle engine to address variations that limit the ability of an operator to accurately obtain the maximum operating level of the vehicle engine. While preferred exemplary embodiments have been presented in the foregoing detailed description of preferred exemplary embodiments, it should be appreciated that a vast number of variations exist. It should also be appreciated that these preferred exemplary embodiments are only examples and are not intended to limit the scope, applicability, or configuration of the invention in any way. Rather, the ensuing detailed description will provide those skilled in the art with a convenient road map for implementing a preferred embodiment of the invention, it being understood that various changes may be made in the function and arrangement of elements described in an exemplary preferred embodiment without departing from the spirit and scope of the invention as set forth in the appended claims.

What is claimed is:

1. An apparatus for adjusting a throttle of a vehicle engine, comprising:

an input sensor configured to provide an input signal having a value that approximately corresponds to an operating level of the vehicle engine requested by an operator;

a memory configured to store a maximum input value for said input sensor, said maximum input value providing said value of said input signal that approximately corresponds to a maximum operating level of the vehicle engine; and a processor configured to receive said input signal and access said memory to retrieve said maximum input value, said processor further configured to update said maximum input value with said value of said input signal if said value of said input signal is greater than said maximum input value.

2. The apparatus for adjusting the throttle of the vehicle engine of claim 1, wherein said processor is further configured to generate a throttle control signal that controls the throttle of the vehicle engine using the maximum input value and the input signal.

3. The apparatus for adjusting the throttle of the vehicle engine of claim 1, further comprising a second input sensor configured to provide a second input signal having a second value that approximately corresponds to the operating level of the vehicle engine requested by the operator.

4. The apparatus for adjusting the throttle of the vehicle engine of claim 3, wherein said memory is configured to store a second maximum input value for said second input sensor, said second maximum input value providing a second value of said input signal that approximately corresponds to said maximum operating level of the vehicle engine.

5. The apparatus for adjusting the throttle of the vehicle engine of claim 4, wherein said processor is configured to receive said second input signal and access said memory to retrieve said second maximum input value.

6. The apparatus for adjusting the throttle of the vehicle engine of claim 5, wherein said processor is configured to update said second maximum input value with said second value of said second input signal if said second value of said second input signal is greater than said second maximum input value and said value of said input signal is greater than said maximum input value.

7. The apparatus for adjusting the throttle of the vehicle engine of claim 6, wherein said processor is further configured to generate said throttle control signal that controls the throttle of the vehicle engine using the maximum input value, said second maximum input value and said input signal.

8. The apparatus for adjusting the throttle of the vehicle engine of claim 1, wherein said vehicle engine is an internal combustion engine.

9. The apparatus for adjusting the throttle of the vehicle engine of claim 1, wherein the throttle includes an electronically controlled intake valve disposed within an intake bore and configured to rotate for adjustment of a flow rate of air through said intake bore.

10. A method for adjusting a throttle of a vehicle engine, comprising:

receiving an input signal having a value that approximately corresponds to an operating level of the vehicle engine requested by an operator;

comparing said input signal to a maximum input value that provides a value of said input signal that approximately corresponds to a maximum operating level of the vehicle engine;

updating said maximum input value with said value of said input signal if said value of said input signal is greater than said maximum input value; and generating a throttle control signal that is configured to control the throttle of the vehicle engine using said maximum input value and said input signal.

11. The method for adjusting the throttle of the vehicle engine of claim 10, further comprising determining whether an error condition exists and setting said maximum input value to a default value if said error condition exists.

12. The method for adjusting the throttle of the vehicle engine of claim 10, further comprising filtering said input signal.

13. The method for adjusting the throttle of the vehicle engine of claim 12, wherein said filtering said input signal is a first order filtering of said input signal.

14. The method for adjusting the throttle of the vehicle engine of claim 10, further comprising determining whether said maximum input value is a valid value.

15. The method for adjusting the throttle of the vehicle engine of claim 14, further comprising setting said maximum input value to a predefined value if said maximum input value is an invalid value.

16. The method for adjusting the throttle of the vehicle engine of claim 10, further comprising receiving a second input signal having a second value that approximately corresponds to the operating level of the vehicle engine requested by the operator.

17. The method for adjusting the throttle of the vehicle engine of claim 16, further comprising comparing said second input signal to a second maximum input value that provides a second value of said second input signal that approximately corresponds to the maximum operating level of the vehicle engine.

18. The method for adjusting the throttle of the vehicle engine of claim 17, further comprising updating said second maximum input value with said second value of said second input signal if said second value of said second input signal is greater than said second maximum input value and said value of said input signal is greater than said maximum input value.

19. The method for adjusting the throttle of the vehicle engine of claim 18, further comprising generating said throttle control signal that is configured to control the throttle of the vehicle engine using said maximum input value and said second maximum input value.

20. An apparatus for adjusting a throttle of a internal combustion engine of an automobile, comprising:

an input sensor configured to provide an input signal having a value that approximately corresponds to an operating level of the internal combustion engine requested by an operator of the automobile;

a memory configured to store a maximum input value for said input sensor, said maximum input value providing said value of said input signal that approximately corresponds to a maximum operating level of the internal combustion engine of the automobile; and a processor configured to receive said input signal and access said memory to retrieve said maximum input value, said processor further configured to update said maximum input value with said value of said input signal if said value of said input signal is greater than said maximum input value and generate a throttle control signal that controls the throttle of the internal combustion engine using the maximum input value and the input signal.

* * * * *